US006113039A

United States Patent [19]

Riffle

[11] Patent Number: 6,113,039

[45] Date of Patent: Sep. 5, 2000

[54] ANTI-CRIMPING HOSE OR CABLE CLAMP

[75] Inventor: Brannon Eric Riffle, Greensboro, N.C.

[73] Assignee: Marconi Commerce Systems Inc., Greensboro, N.C.

[21] Appl. No.: 09/322,796

[22] Filed: May 28, 1999

[51] Int. Cl.[7] ..... A62C 13/76; E21F 17/02; B67D 5/12

[52] U.S. Cl. ..... 248/75; 248/62; 248/63; 222/74

[58] Field of Search ..... 248/75, 51, 52, 248/62, 329, 332, 63; 137/355.23, 355.2; 242/615.1, 615.2, 157.1, 615.3; 226/194, 168; 222/74

[56] References Cited

U.S. PATENT DOCUMENTS

| | | | |
|---|---|---|---|
| 90,454 | 5/1869 | Lovell . | |
| 1,390,539 | 9/1921 | Perkins . | |
| 1,446,648 | 2/1923 | Kostlan . | |
| 1,712,176 | 5/1929 | Stirdivant . | |
| 1,787,106 | 12/1930 | Glazener . | |
| 2,170,557 | 8/1939 | Guarnaschelli | 138/61 |
| 2,986,364 | 5/1961 | Vestal | 248/75 |
| 3,029,933 | 4/1962 | Sutter | 206/46 |
| 3,065,760 | 11/1962 | Cailas | 134/167 |
| 3,143,367 | 8/1964 | Mac Donnell | 287/92 |
| 3,165,286 | 1/1965 | Johnson et al. | 248/75 |
| 3,352,582 | 11/1967 | Mankin et al. | 287/89 |
| 3,851,979 | 12/1974 | Becker | 403/76 |
| 3,897,923 | 8/1975 | Paepke et al. | 248/75 |
| 3,941,412 | 3/1976 | Carpenter | 248/75 |
| 3,958,784 | 5/1976 | Bourrieres | 248/63 |
| 4,068,824 | 1/1978 | Flynn | 254/124 |
| 4,163,457 | 8/1979 | Rickel et al. | 137/216 |
| 4,195,674 | 4/1980 | Madden | 248/75 |
| 4,470,177 | 9/1984 | Ganung et al. | 248/75 |
| 4,998,693 | 3/1991 | Wiebe | 248/75 |
| 5,007,605 | 4/1991 | Horvath | 248/62 |
| 5,192,039 | 3/1993 | Williams | 248/62 |
| 5,427,339 | 6/1995 | Pauli et al. | 248/75 |
| 5,836,361 | 11/1998 | Koncsek | 141/279 |
| 5,979,840 | 11/1999 | Hollister et al. | 248/75 |

*Primary Examiner*—Ramon O. Ramirez
*Assistant Examiner*—Jon A. Szumny
*Attorney, Agent, or Firm*—Coats & Bennett, P.L.L.C.

[57] ABSTRACT

A suspension device for effecting a connection between a support structure and a flexible elongated element. Element has an annular collar that is configured to securely retain a segment of the flexible elongated element. A housing having upper and lower ends, includes a cylindrical interior portion that captively encircles the collar and its associated element in a manner permitting radial movement of the collar. The uppermost end of the housing is pivotally attached via a cable to the support structure. The lower portion of the housing includes a pulley-like configuration for limiting longitudinal bending of the flexible elongated element to a radius of curvature greater than the crimp radius of the element, and a pair of opposing radially directed lip-like wall members extending from the sides of a groove of the pulley for restricting lateral bending of the flexible elongated element against side of the collar.

22 Claims, 11 Drawing Sheets

ANTI-CRIMPING HOSE OR CABLE CLAMP

FIELD OF THE INVENTION

The present invention relates generally to a hose or cable suspension system, and more particularly to a device for preventing kinks or crimps in a suspended hose or cable at the point of attachment to a support structure.

BACKGROUND OF THE INVENTION

There are numerous industrial and commercial applications which require flexible elongated elements such as hoses, cables, wires, ropes and the like, to be suspended from a support structure. As one specific example, it is common practice to mount a spring-actuated reel on or within a gasoline pump housing and connect the retriever cable of the reel to the hose so that the hose will be automatically urged to return to the pump housing when the use of the hose is completed. In other words, instead of retracting the hose into the pump housing after each use, the retriever cable only, is retracted into its housing and at least most of the hose is held off of the ground by the retriever cable, but on the outside of the pump.

Most prior art devices simply employ a collar fixedly secured to a point of the hose and a cable is attached to the collar and support structure for raising the collar, and in turn, the section of the hose to which the collar is attached. Several problems have been encountered during the use of such devices. Since the collar extends transversely across the suspended hose, the force exerted by the hose's own weight often causes the hose to become crimped at the point of attachment. Sometimes, just the act of pulling on one end of the hose can also cause it to bend at the collar and result in crimping. The stress exerted upon the material from such crimping and extreme flexing leads to ultimate failure of the hose.

Often, the prior art devices' ability to pivot or swivel is limited to only one axis. As a result, it is not unusual for the device and/or hose to be positioned so that the hose is pinched laterally, thereby distorting the hose wall. That is, because of the inflexibility of the construction of existing devices, the force applied to the device by the cable often twists or distorts the hose so that it is difficult to handle and is sometimes even damaged. In a manner similar to the kinking of the hose as described above, lateral movement of the hose with respect to the clamp induces the hose to bend against the side of the device which results in kinking or crimping.

Most known prior art devices fixedly clamp on the wall of the hose and allow no radial movement of the hose at the gripped portion. The problem occurs when a torsional twisting force is applied to the length of the hose. As the force is transferred along the length, the device restricts the twisting tendency of the gripped portion. The result is a radial twisting of the hose that distorts the hose wall inward, eventually leading to structural failure.

One practical example involves modem automotive fuel dispensing equipment. As described above, the equipment typically employ hose configurations that provide the fueling customer with extra hose reach by using a hose clamp and retractor/retriever mechanism to loop or coil an additional length of hose near the top of the dispenser. To help maintain minimum air quality standards, many legislative jurisdictions require the use of vapor recovery systems in such fuel dispensing equipment. Such systems require the use of a coaxial type of fuel delivery hose (hose in a hose design), where the fuel flows in one coaxial line and recovered vapors flow back through the other. Typically, such hoses are substantially heavier per unit length compared to simple hoses, and therefore are more prone to having the inner and outer lines kink or crimp adjacent to the hose clamp when used with overhead loop/coil configurations. The resulting crimp in the vapor line, prevents the vacuum assist vapor recovery systems from functioning properly.

For the foregoing reasons, there is a need for an improved device for suspending a flexible elongated element that prevents crimping and/or pinching of the suspended element, is simple and inexpensive to manufacture and assemble, is composed of few parts, and has the strength and durability to withstand the rough treatment and use encountered by the suspended element, for example, the hose of a gasoline pump.

SUMMARY OF THE INVENTION

The present invention is directed to a suspension device that will prevent a flexible elongated element from kinking or crimping at the point proximate the clamped portion thereof. In a particular aspect of the present invention, there is provided a suspension device for effecting a connection between a support structure and a flexible elongated element, the device comprising:

a) an annular collar being configured for gripping securely around a segment of said element, said collar having first and second ends;

b) a housing having upper and lower ends, and an interior portion proximate said upper end for captively encircling said collar and center axis of said element;

d) said upper end being configured for pivotal attachment with said support structure therewith; and e) said lower end being configured to limit longitudinal bending of said element to a radius of curvature greater than the crimp radius of said element, and being configured to restrict lateral bending of said element against said first and second ends of said collar.

The preferred embodiment of the invention utilizes a fixed pulley or bending die to limit the degree of bending to a radius of curvature above the radius that would result in hose or cable kinking or crimping. Along the circumference of the die, a pair of opposing lips extend therealong to form a groove. The lips urges the clamp to be aligned with the direction of the pull to prevent or restrict lateral movement of the hose with respect to the opening of the clamp. Thus, the lips prevent lateral bending against the side of the clamp. The clamp also employs an inner collar that clamps on the hose or cable, and captively resides in the clamp housing. The collar is configured to slide or rotate radially within the clamp housing. Radial movement of the hose is thereby permitted by the clamp, for minimizing any pinching of the hose walls inward due to twisting force exerted during use.

Optionally, the fixed pulley portion may be of a semicircular configuration to save weight and material. In another embodiment, the fixed pulley portion may have a plurality of bores extending transversely therethrough to reduce overall weight and material while maintaining rigid strength.

BRIEF DESCRIPTION OF THE DRAWINGS

The various embodiments of the invention are described in detail below with reference to the drawings, in which like items are identified by the same reference designation, wherein.

DETAILED DESCRIPTION OF THE INVENTION

Figure 1:
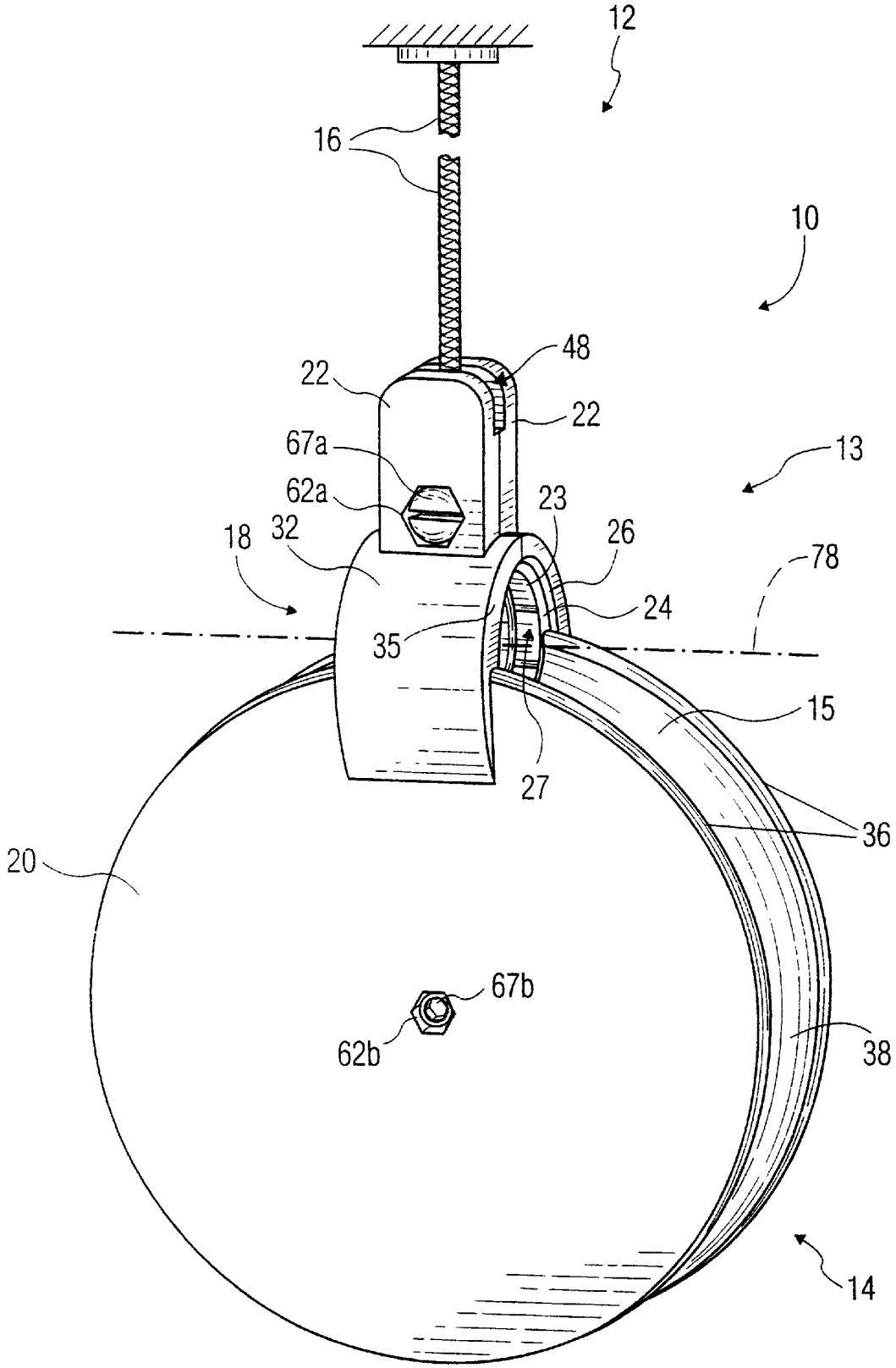
FIG. 1 is a pictorial view of an embodiment of the invention.

Referring now to the drawings, FIG. 1 shows one embodiment of a suspension device of the invention designated generally by the reference character 10. The suspension device 10 or "device" hereinafter, is especially useful for suspending a flexible elongated element from a support structure during use and storage. The embodiment depicted in FIG. 1 illustrates a device 10 in a form designed to accommodate fluid delivery hoses such as coaxial vapor recovery/fuel delivery hoses, for example. As used herein the term "hose" shall refer to a particular embodiment of the flexible elongated element intended for use in the present invention. However, one of ordinary skill in the art would certainly recognize that various other forms of flexible elements such as cables, ropes, wires, and the like may be accommodated within the spirit and the scope of the invention.

Figure 2:
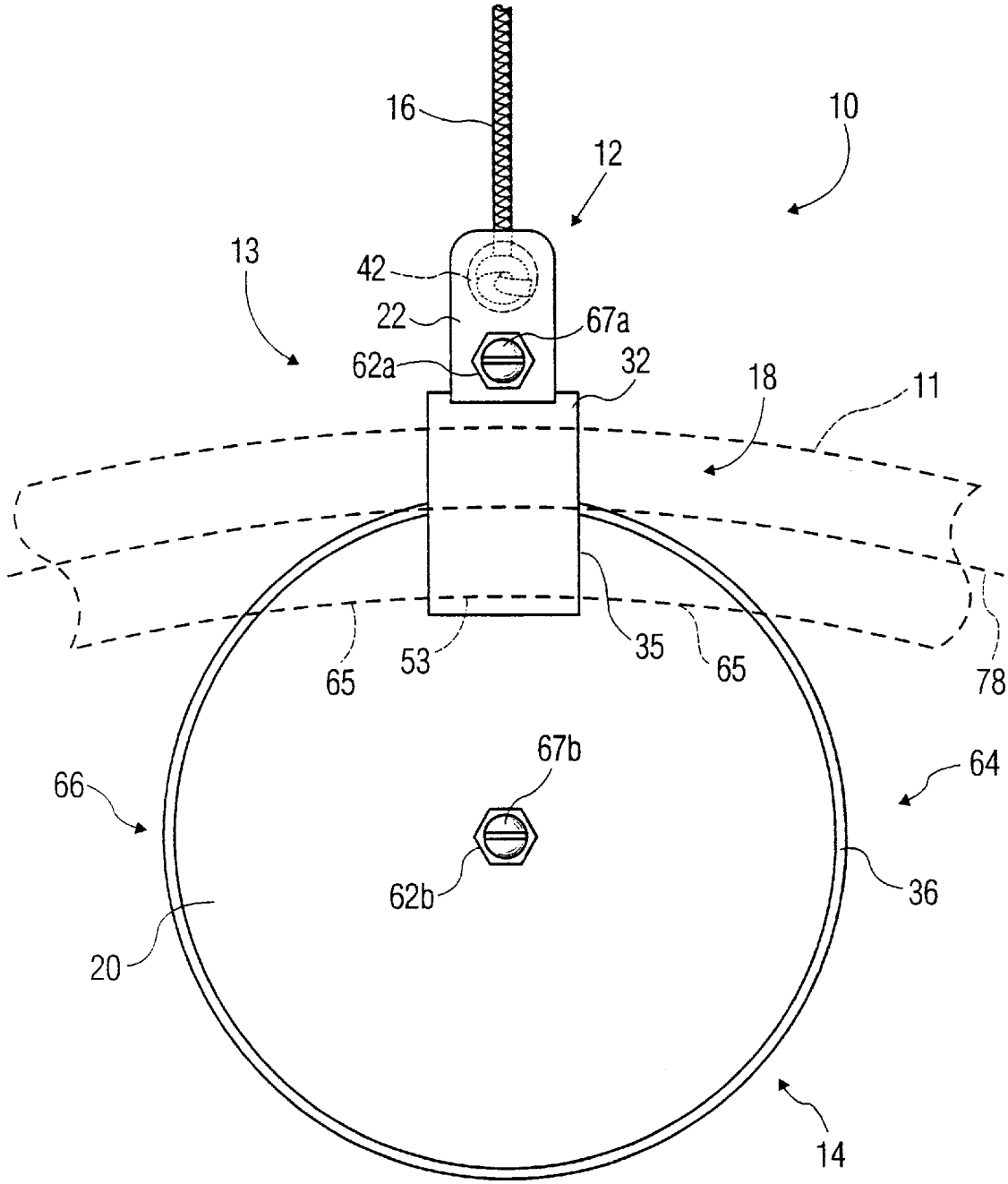
FIG. 2 is a side elevational view of the device shown in FIG. 1.
Figure 3:
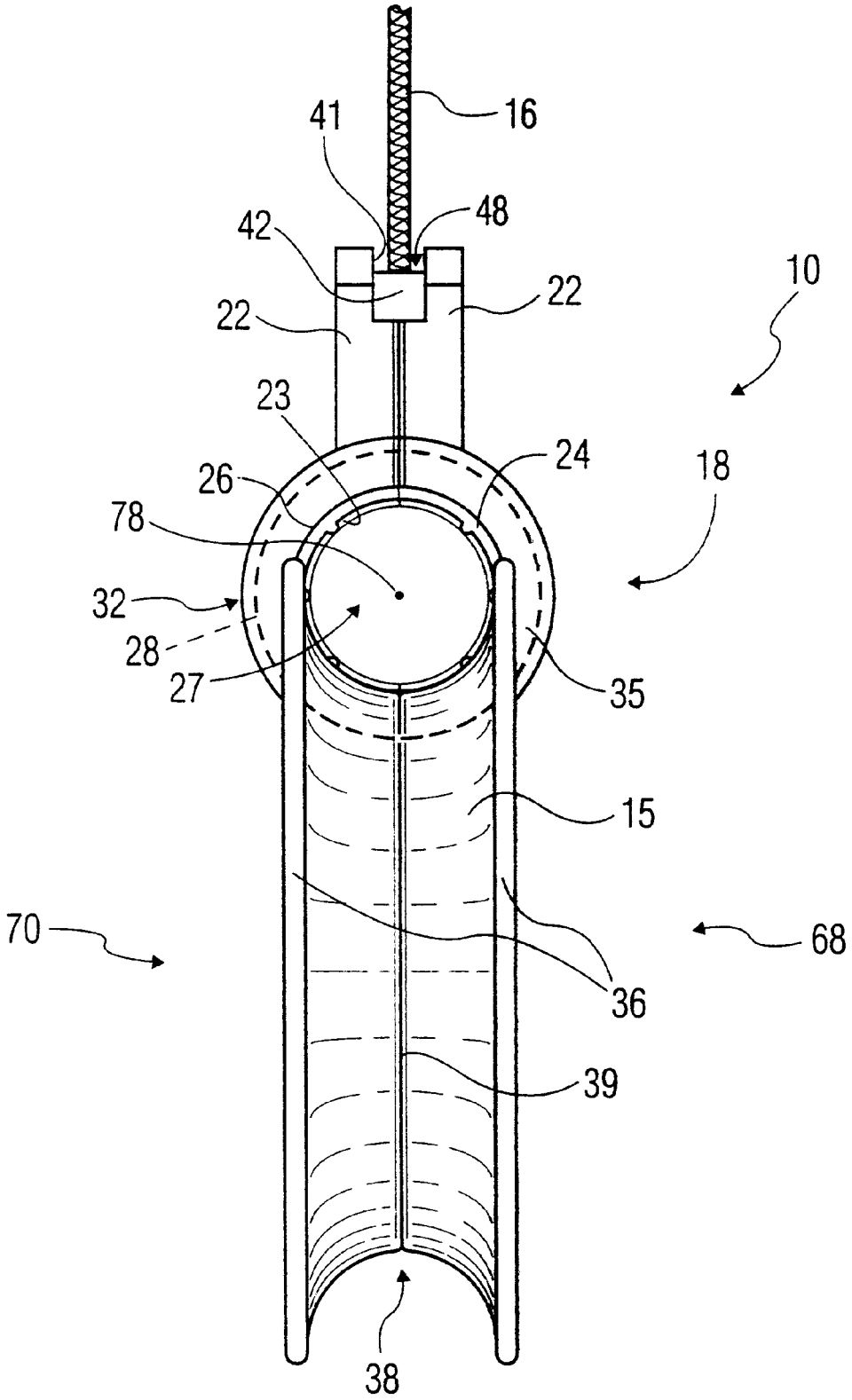
FIG. 3 is a front elevational view of the device shown in FIG. 1.

With reference to FIGS. 1, 2, and 3, the device 10 comprises upper 12, middle 13, and lower 14 portions. The middle portion 13 includes a hose clamp 18 having a cylindrical housing 32 and an inner collar 24, for clamping securely to a segment 53 of a hose 11 (as shown in FIG. 2) while permitting the hose 11 to rotate radially. By allowing the hose 11 to rotate freely in the clamp 18, the inward pinching of the hose walls is avoided when a radial twisting force is applied to the length of the hose 10. The rotating means will be described hereinafter.

The upper portion 12 includes upwardly protruding studs 22 having a cable pin 42 pivotally seated therebetween for receiving one end of a retriever cable 16 for suspending the hose 11 in the air at the point of attachment as described hereinafter. The lower portion 14 includes a circular fixed pulley 20 that acts as a bending die having a radius of curvature greater than the kink radius that would cause the hose 11 to kink or crimp at a portion 65 adjacent to the clamp 18. The bending die or fixed pulley assembly 20 is not limited to the illustrated embodiment only, but may include other forms and devices that form a curvillinear surface to restrict bending of a hose 11 when force is applied to the hose 11, such as elongated coiled springs, flexible spring strips, hinged saddles, and the like as recognized by one of ordinary skill in the art.

The clamped segment 53 of the hose 11 occupies a cylindrical through hole 27 as defined by the inner collar 24 within the cylindrical housing 32. The axis 78 of the hose 11 is aligned with the center axes of both the through hole 27 and the cylindrical housing 32. The inner collar 24 is captively retained by a portion of the fixed pulley 20 and sidewalls 35 of the housing 32 extending around openings 26 at both sides 64 and 66 of the device 10. Thus, the clamped segment 53 of the hose 11 remains fixed in place within the housing 32 to prevent any longitudinal movement thereof.

Referring specifically to FIG. 3, a longitudinal groove 38 with a curvilinear surface 15 extends substantially along the circumference of the fixed pulley 20. A center line 39 of the groove 38 is aligned with the center axis 78 of the clamp 18 and hose 11 combination, and is configured to releasably seat substantially the lower radial portion of the hose 11. A reinforcing lip 36 runs along each side of the groove 38. In the preferred embodiment, the lip 36 extends beyond the level of the center axis 78 of the hose 11. This assures that the hose 11 is securely seated within the groove 38 and that the clamp 18 remains aligned with the direction of the pull on the hose 11, thus preventing the hose 11 from bending against the side at the opening 26 of the clamp 18 during use.

Figure 4:
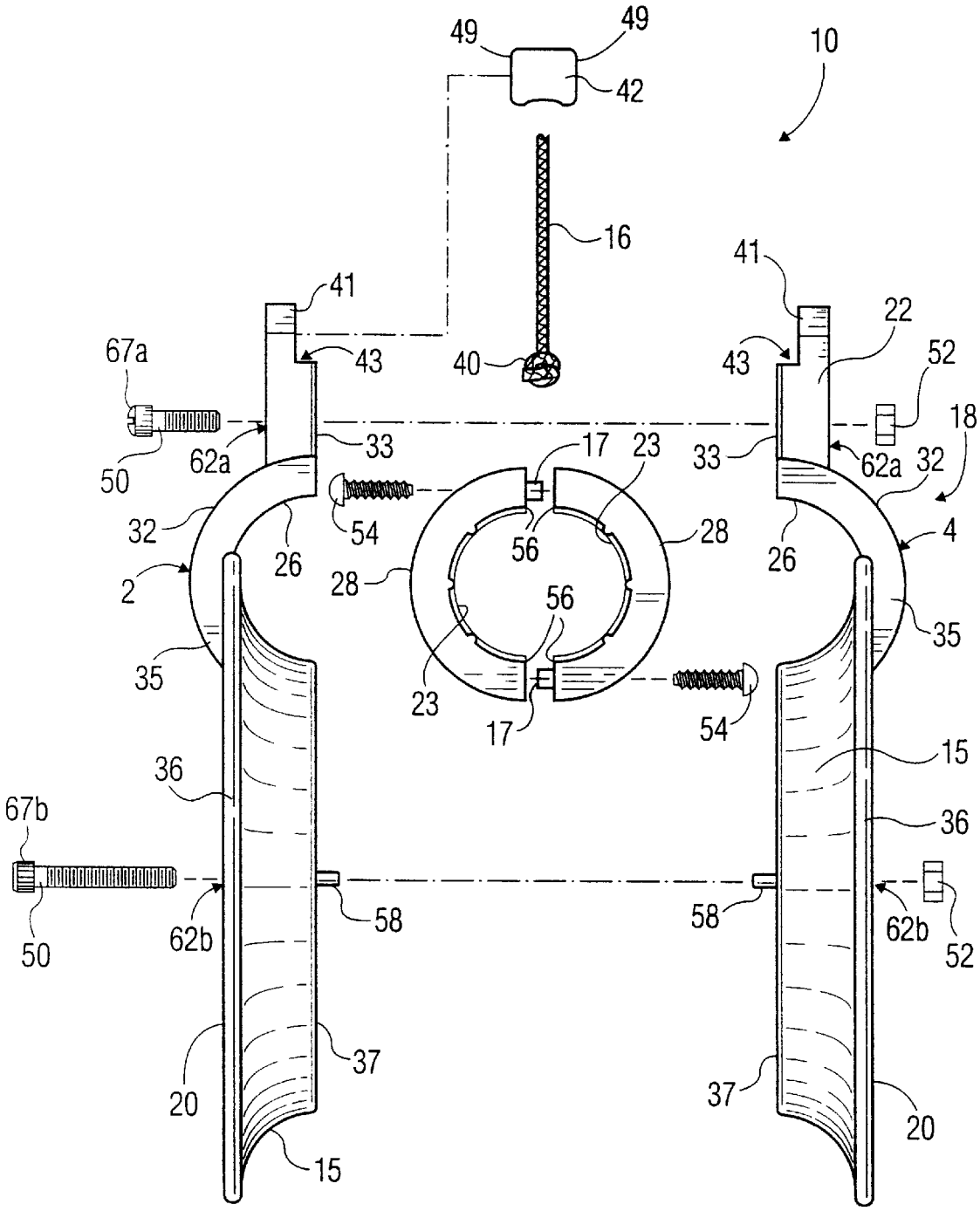
FIG. 4 shows an exploded assembly view of the principal component parts of the embodiment of the invention shown in FIG. 1.

As shown in FIG. 4, jacket parts 2 and 4 jointly form the studs 22, housing 32 and fixed pulley 20. The device 10 possesses symmetry between sides 68 and 70 (see FIG. 3), and between sides 64 and 66 (see FIG. 2). This quadrilateral symmetry provides a manufacturing advantage. Because of this feature, the jacket parts 2 and 4 are identical pieces in shape and form. A single mold or fabricating machine may be utilized to make the jacket parts 2 and 4, thereby generating savings in manufacturing costs.

Figure 5:
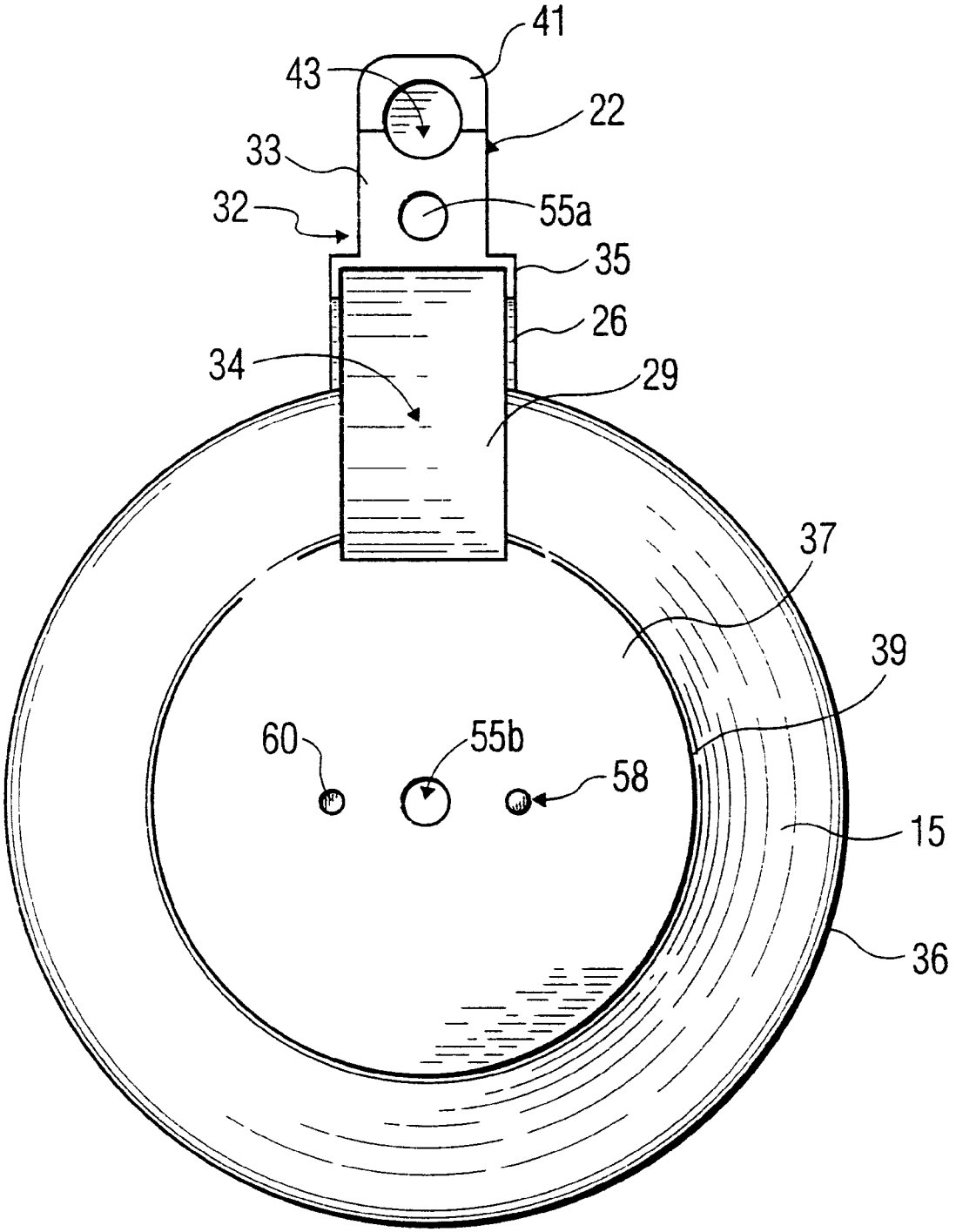
FIG. 5 shows an inside elevational view of one of the outer portions of the two halves of the device shown in FIG. 1.

Referring specifically to FIGS. 4 and 5, the jacket parts 2 and 4 are opposingly coupled to each other by mating of index pins 58 with associated index sockets 60 of interior surface 37 and fastened with nuts 52 and bolts 50 through the through holes 55*a* and 55*b* at the upper and lower portions 12 and 14, respectively. Further, interior surfaces 33 and 37 are flat and configured for coupling abuttingly with counterpart surfaces 33 and 37, respectively, of counterpart jacket part 2 or 4. Upon coupling of jacket parts 2 and 4, an annular channel 34 is jointly formed by interior surface 29 of housing 32, sidewalls 35 and a portion of the fixed pulley 20. The annular channel 34 is configured to captively retain and seat the inner collar 24. The surface 29 of the annular channel 34 coacts with the exterior portion of the collar 24 for sliding or radial movement as described hereinafter.

On the exterior portion, as illustrated in FIG. 2, a pair of countersunk fastening recesses 62*a* and 62*b* are disposed at the upper and lower portions 12 and 14 of the device 10, respectively. An internally threaded fastening through hole 55*a* and 55*b* (see FIG. 5) communicates between each pair of recesses 62*a* and 62*b*, respectively. The recesses 62*a* and 62*b* are configured to accommodate hexagonal nuts 52 and bolt heads 67*a* and 67*b*. The recesses 62*a* and 62*b* permit the nuts 52 and bolt heads 67*a* and 67*b* to be concealed and flush with the exterior surface. A small plastic cap (not shown) may be optionally placed over the fastening means in each of the recesses 62*a* and 62*b*.

As best shown in FIGS. 4 and 6A–6C, the collar 24 (see FIG. 3) is composed of two opposing arcuate members or shells 25 fastened together by a pair of threaded connecting screws 54. The arcuate shells 25 are C-shaped and configured to fit opposingly with each other for jointly forming the collar 24 that encircles a segment 53 of the hose 11 as previously described (see FIG. 2). The shells 25 are fixedly interconnected in a clamping arrangement on the hose 11 by the pair of screws 54 which are positioned on diametrically opposite sides of the hose 11 and coact between adjacent opposed end faces 56 of the associated shells 25. For this purpose, each end face 56 is provided with a fastening through hole 57 or 59. The through holes 57 and 59 of one shell 25 become substantially aligned with corresponding through holes 59 and 57, respectively, of the other shell 25 when the shells 25 are disposed in opposed relationship to one another.

Like the jacket parts 2 and 4 (see FIG. 4), the shells 25 are identical in shape and form to one another. An index pin 17 is disposed on the corner of one end face 56 and an index socket 19 is disposed on the same corner of the other end face 56 (as shown in FIG. 6C) for ensuring proper alignment during coupling. To affix the collar 24 to the hose 11, each shell 25 is positioned opposingly to each other with the hose 11 placed in the intrados portion 23 between the shells 25. The intrados portion 23 of the shell 25 is provided thereon with a series of circumferential ridges 30 and radial ridges 31 (shown in FIG. 6C) to effect a better gripping surface for the hose 11 when clamped in position. The pair of shells 25 are properly aligned and coupled with one another by the mating of index pins 17 to the associated index sockets 19. A screw 54 is inserted into each of the aligned through holes 57 and 59 at adjacent end faces 56 to securely fasten the coupled shells 25 together onto the hose 11.

Figure 6A:
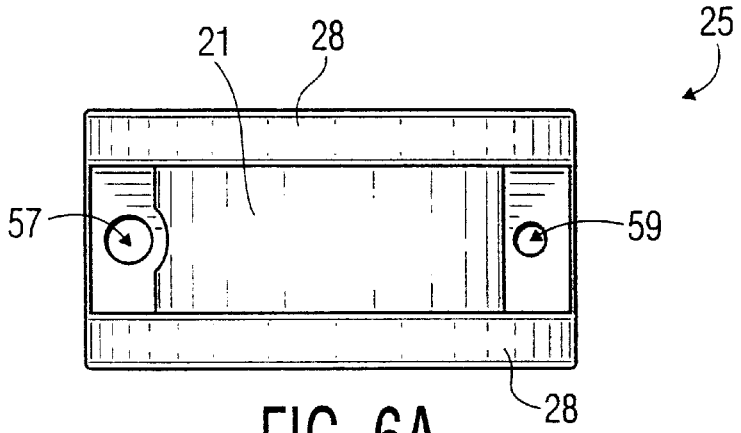
FIG. 6A is an outside elevational view of one of the arcuate shells shown in FIG. 4.
Figure 6B:
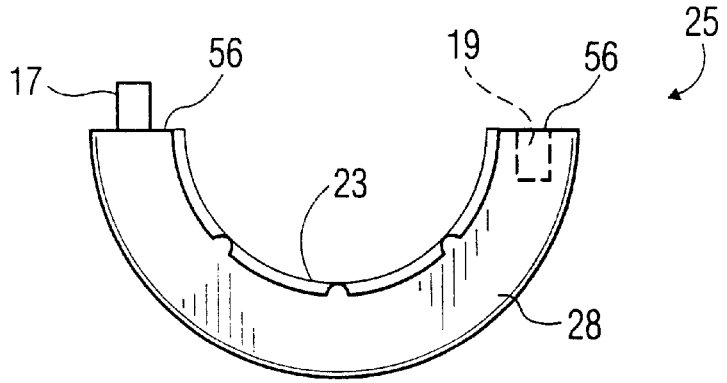
FIG. 6B is a side elevational view of the arcuate shell shown in FIG. 6A.
Figure 6C:
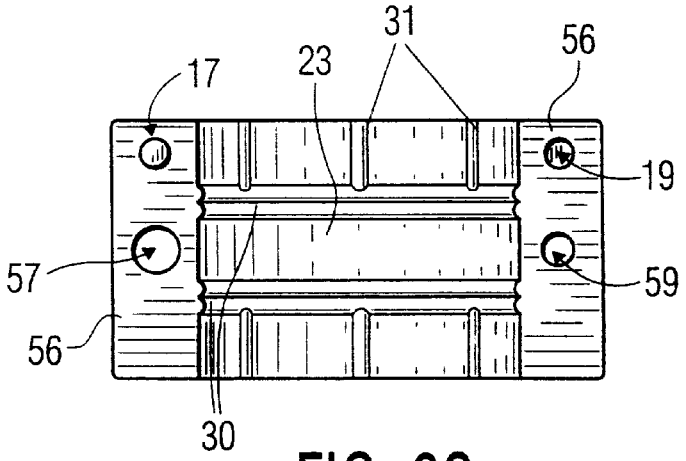
FIG. 6C is an elevational view of the inside of the arcuate shell shown in FIG. 6A.

With specific reference to FIGS. 6A and 6B, the exterior surface 21 of the collar 24 includes a pair of annular ribs 28, each circumscribing a portion of the surface 21 at both ends of the through hole 27. The ribs 28 coact with the surface 29 of the annular channel 34 and ensures that the hose 11 stays radially centered within the housing 32. The ribs 28 also serve to reduce any frictional resistance between the collar 24 and the surface 29 of the annular channel 34, thereby facilitating radial sliding movement of the collar 24 along the channel 34 within the housing 32. The collar 24 is captively held within channel 34 via the ribs 28. The radial rotation means of the collar 24 within the housing 32 is not limited to the annular ribs 28 described above, and may include other forms and devices such as ball bearings, roller bearings, antifriction bushings, and the like as recognized by one of ordinary skill in the art.

Figure 4A:
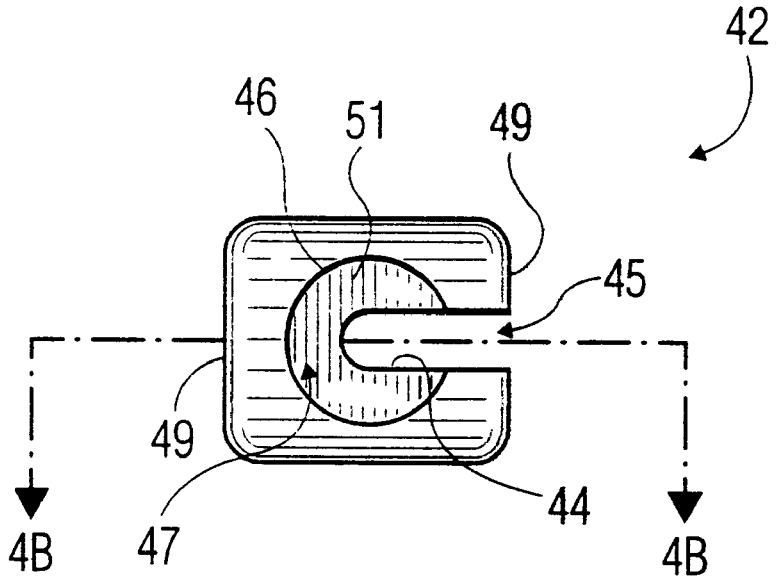
FIG. 4A is a bottom plan view of a cable pin shown in FIG. 4.

Referring specifically to FIGS. 3, 4, and 5, the device 10 is provided with a suitable swivel structure mounted thereon for pivotally attaching the free end of the retriever cable 16 to the clamp 18. For this purpose, a pair of upwardly projecting studs 22 includes opposing pin mounting recesses 43 (as shown in FIG. 5) disposed in the opposing interior surfaces of the studs 22. The recesses 43 are configured to receive and retain the cylindrical cable pin 42 between the studs 22. The ends 49 (as shown in FIG. 4A) of the cable pin 42 are seated in the associated pin mounting recesses 43 and in combination allows for swiveling action to enable the retriever cable 16 to pivot freely relative to the studs 22 about an axis normal to that of the hose 11. A stepped portion 41 of each stud 22 jointly forms a space 48 to allow the cable 16 to pivot freely therebetween (as best shown in FIG. 3). The cable pivot means permits the device 10 to remain substantially vertically oriented as the hose 11 is pulled out of storage position, and reduces the wear and tear on the cable 16 at the point of attachment to the cable pin 42.

Figure 4B:
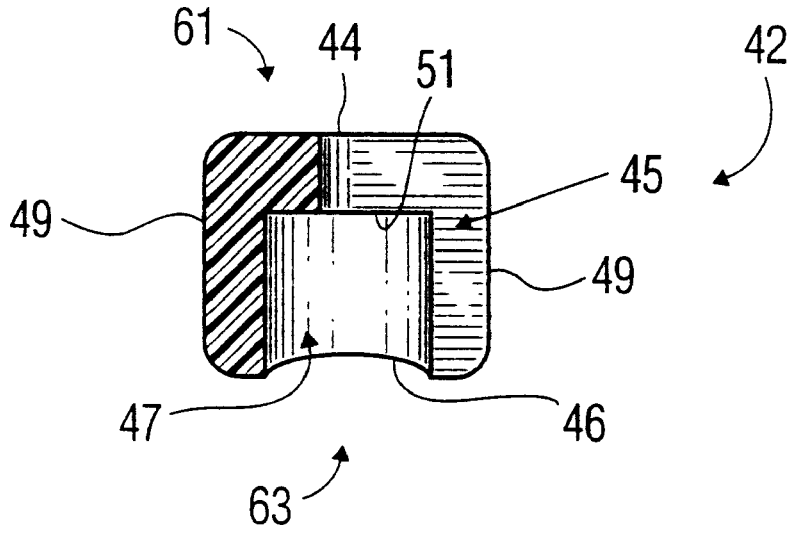
FIG. 4B is a cross sectional view taken along 4B—4B of the cable pin of FIG. 4A.

The cable pin 42, as illustrated in FIGS. 4A and 4B, includes a slit 45 that extends from one end 49 to a portion 44 intermediate the length of the cable pin 42. The lower portion 63 includes a stepped bore 47 in communication with the slit 45. The stepped bore 47 is provided with a larger bottom opening 46 and a ceiling portion 51. The cable 16 with a knot 40 tied at the free end (see FIG. 4), is inserted laterally through the slit 45. During insertion, the knot 40 must be positioned below the pin 42 to clear the slit 45 and its diameter must be larger than the width of the slit 45 for effective retainment. Once the cable 16 is positioned at the diametric portion 44 of the pin 42, the knot 40 is pulled upwardly towards the upper portion 61. The knot 40 being drawn into the stepped bore 47, abuts against the ceiling 51, thereby securely retaining the cable end therein. The knot 40 being concealed within the stepped bore 47 is prevented from interfering with the swivel action of the cable pin 42.

The arcuate clamping shells 25, the cable pin 42 and the jacket parts 2 and 4 are preferably constructed of a hard plastic material so that the associated surfaces of the device 10 are spark-proof and resistant to corrosion. Further, by constructing the shells 25, the cable pin 42, and the jacket parts 2 and 4 from the hard plastic material, there is provided a minimum of frictional resistance to movement of the collar 24 and the cable pin 42 relative to the surface 29 of the annular channel 34 and pin mounting recesses 43, respectively. At the same time, there is provided a very low rate of wear between the coacting surfaces thereof. Thus, the above-mentioned members may desirably be made of a hard plastic material having anti-frictional properties such as nylon or PTFE (polytetrafluoroethylene), for example.

Figure 7:
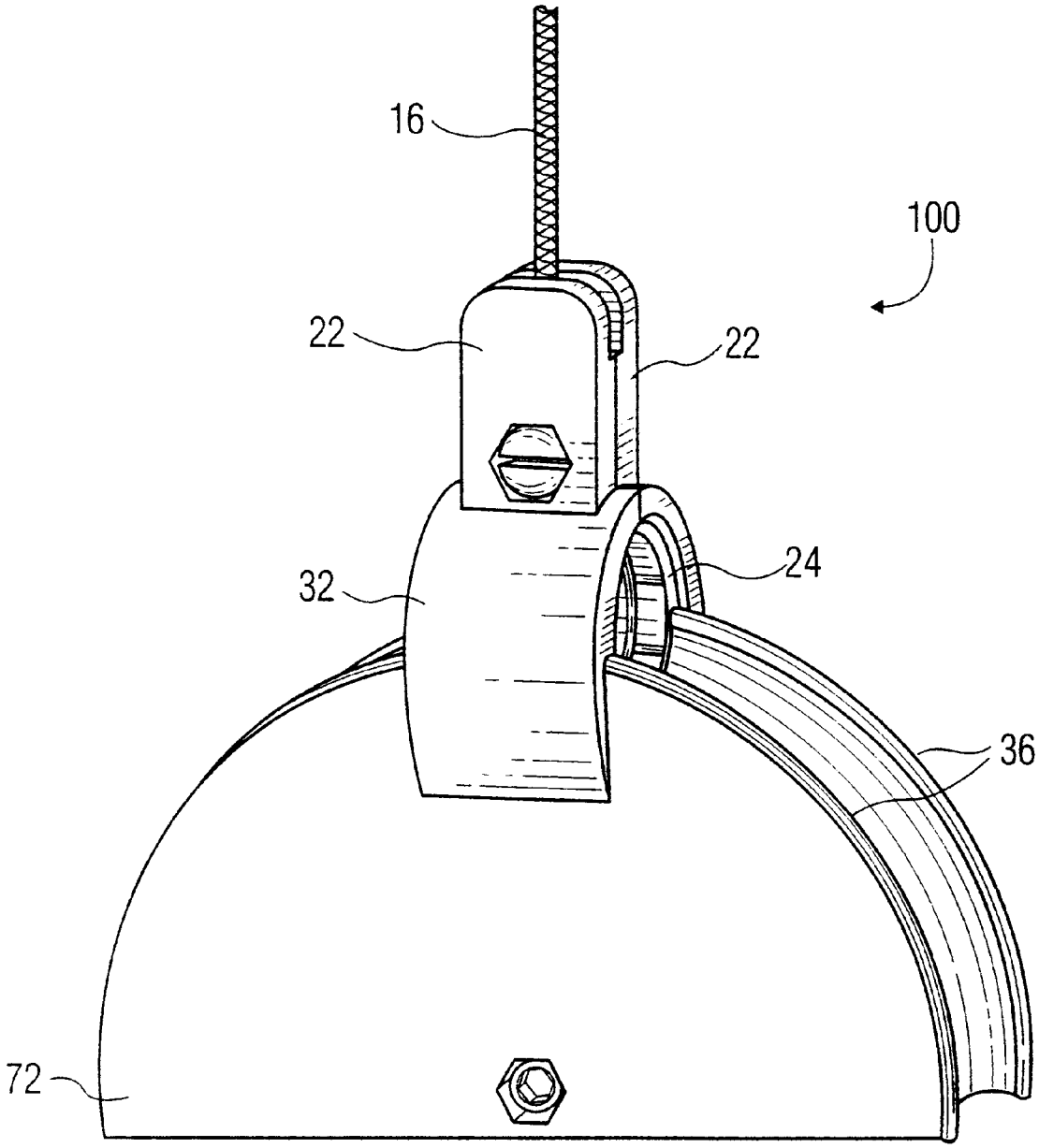
FIG. 7 shows a side pictorial view of an alternative embodiment of the invention where the fixed pulley portion is of a semi-circular configuration.
Figure 8:
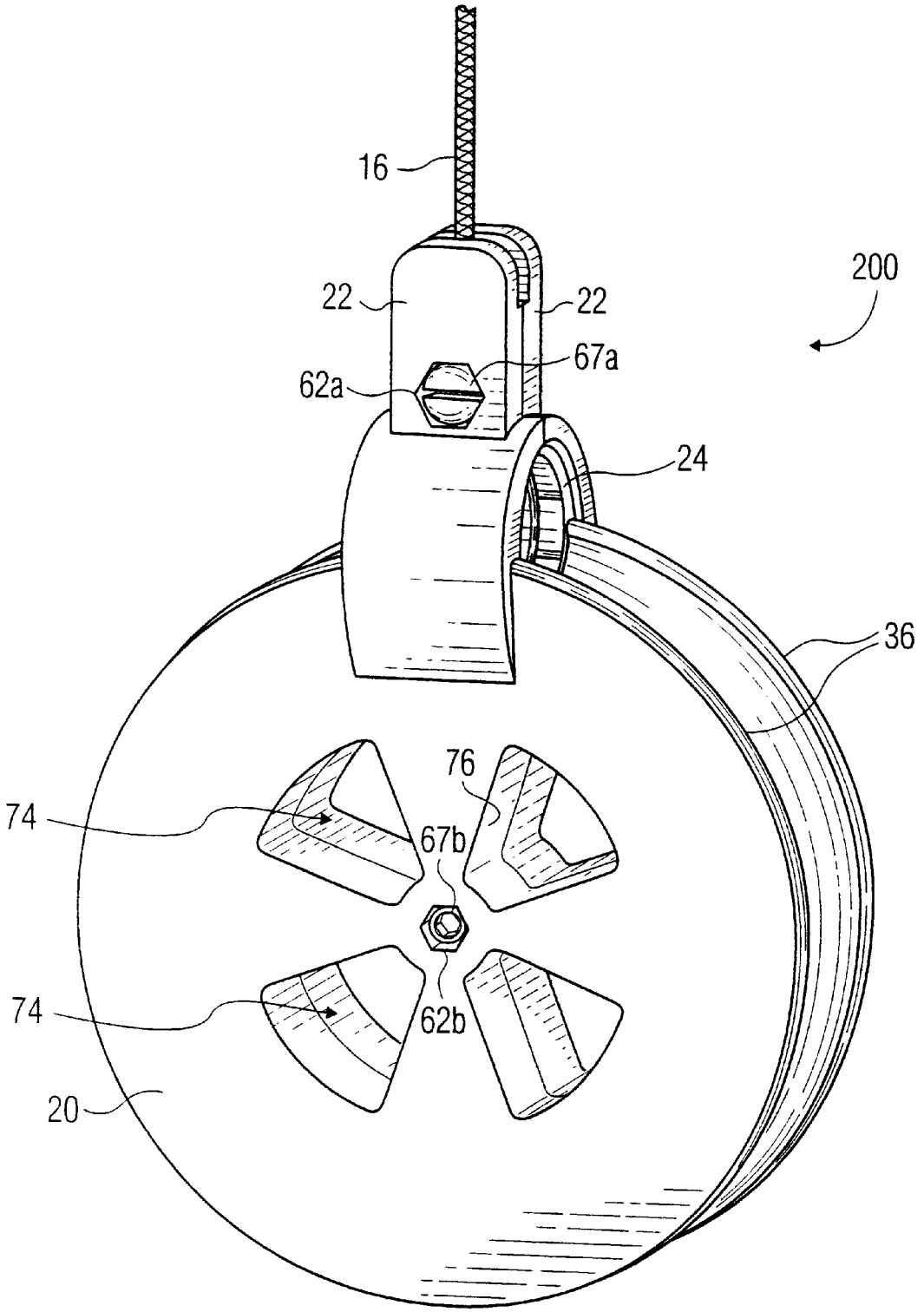
FIG. 8 shows a side pictorial view of an alternative embodiment of the invention where portions of the fixed pulley are punched out to form bores extending transversely therethrough.
Figure 9:
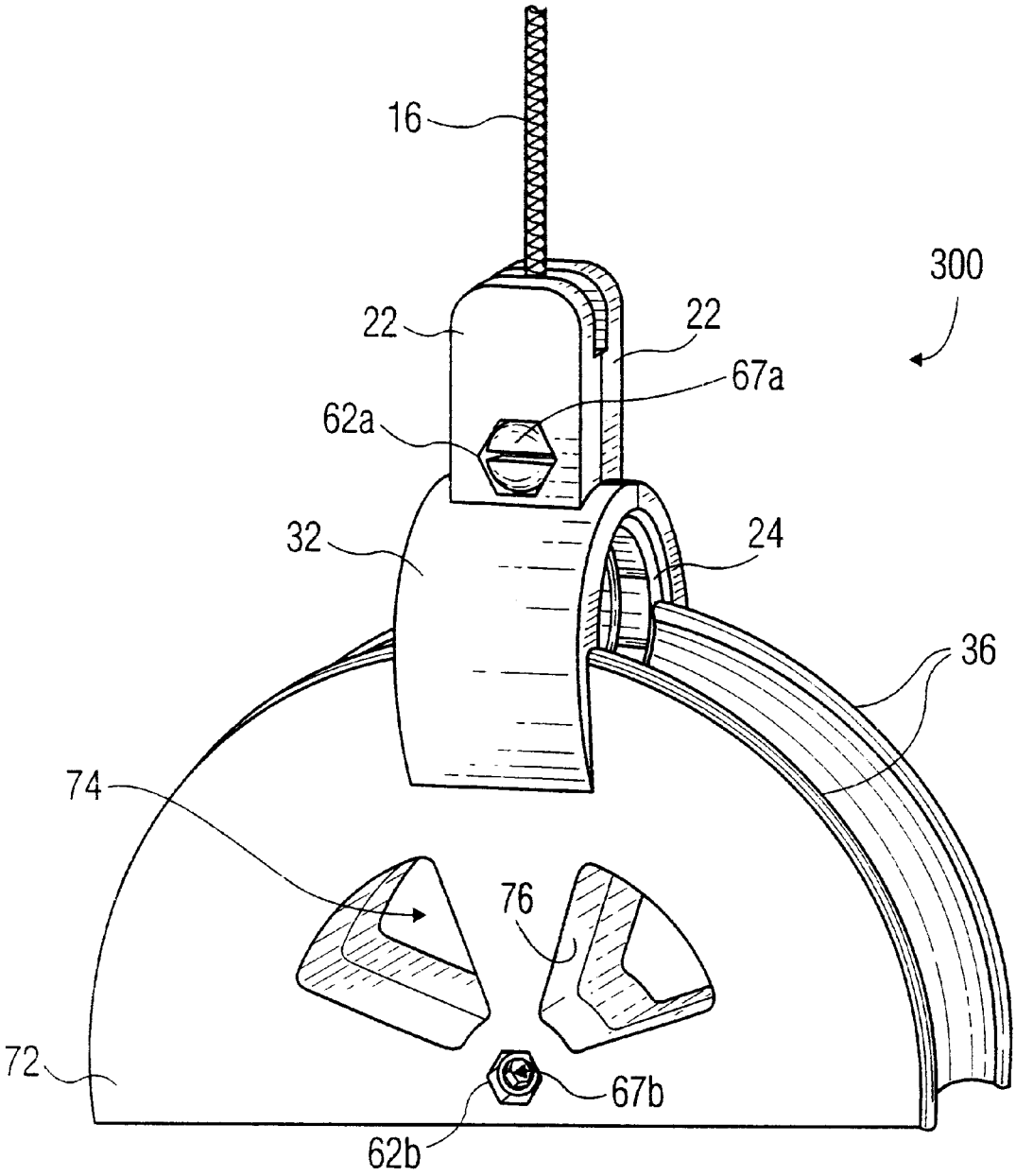
FIG. 9 shows a side pictorial view of an alternative embodiment of the invention having a semi-circular fixed pulley portion and a plurality of bores extending transversely therethrough.

With reference to FIGS. 7, 8, and 9, three alternative embodiments are illustrated, a second embodiment of the present invention generally designated by reference numeral 100, a third embodiment generally designated by reference numeral 200, and a fourth embodiment generally designated by reference numeral 300. Each of the embodiments are variations on the fixed pulley structure of the invention as described above. In FIG. 7, the embodiment 100 includes a fixed pulley 72 having a semicircular configuration. In FIG. 8, the embodiment 200 is shown with a circular fixed pulley 20 provided with a plurality of bores 74 extending therethrough defining support struts 76 therebetween. This embodiment 200 benefits from savings in weight and fabricating material. In FIG. 9, the embodiment 300 is shown with the semicircular fixed pulley 72 provided with the bores 74 extending transversely therethrough.

Figure 10:
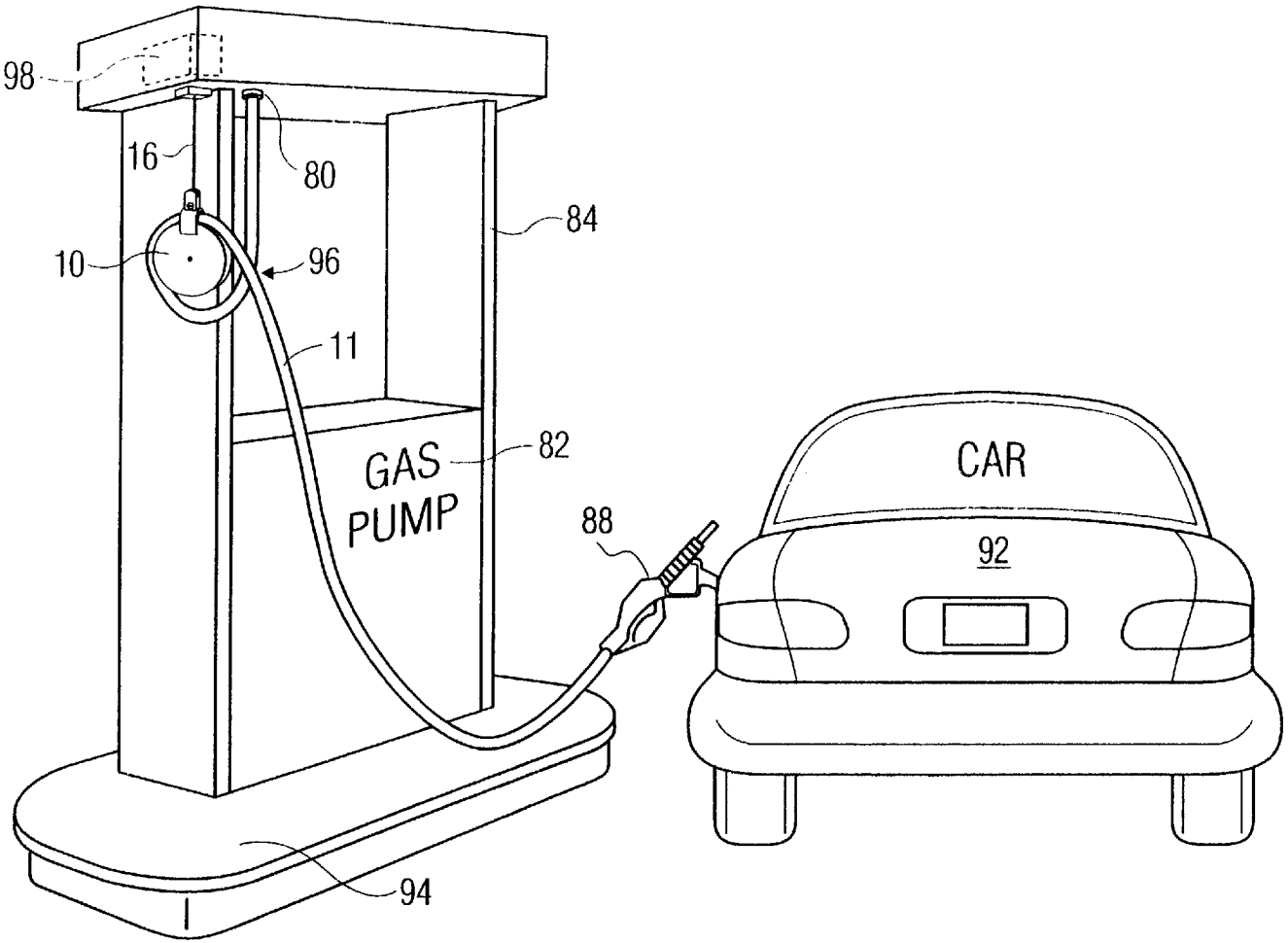
FIG. 10 illustrates one example of the environment where the device of the present invention may be used.

With reference to FIG. 10, an example of one use of the subject invention in its various embodiments is shown relative to a gasoline pump 82. In such a gasoline fuel dispensing system, a gasoline station attendant can pull the nozzle end 88 of the hose 11, causing the retriever cable 16 to be played out for moving the hose 11 and nozzle 88 assembly to fuel an automobile 92. After fueling, the retriever cable 16 winds back into a self-propelled spring-loaded reel 98 in pump housing 84 to return the clamped portion of the hose 11 to an overhead position for storage where at least most of the hose 11 is held off island 94 and the ground by the retriever cable 16. In addition to preventing kinks, the device 10 in cooperation with the loop/coil hose configuration 96, minimizes the stress experienced by the hose portion proximate the connector 80 from excessive pulling and flexing during use.

In this example, any one of the various embodiments of the invention can be used in association with a gasoline pump to substantially avoid crimping or excessive bending of the gasoline supply hose during use. However, the present invention is not meant to be limited to use with gasoline pumps only, and is applicable for use in any system in which excessive bending or crimping of flexible hoses or cables must be avoided during uses of the hoses or cables, particularly where the hoses or cables are played out from overhead loop/coil configurations.

Although various embodiments of the invention have been shown and described, they are not meant to be limiting. Those of skill in the art may recognize various modifications to these embodiments, which modifications are meant to be covered by the spirit and scope of the appended claims.

What is claimed is:

1. A suspension device for effecting a connection between a support structure and a flexible elongated element, said device comprising:

an annular collar being configured for gripping securely around a segment of the element, said collar having first and seconds ends;

a housing having upper and lower ends, and an interior portion proximate said upper end adapted to captively encircle said collar and a center axis of the element;

said collar being mounted for rotation within said interior portion parallel with the center axis of the element; and said upper end adapted to be configured for pivotal attachment with the support structure herewith.

2. The device of claim 1, wherein said housing further comprises:

two identical outer sections each forming a half section of said housing, said half sections having inner surfaces adapted to be adjacent with each other when said device is assembled with said half sections secured together; and a semicircular recess being formed within said interior portion proximate said upper end of each of said outer half sections, said two semicircular recesses forming a substantially cylindrical recess when said outer half sections are assembled together.

3. The device of claim 1 further including for rotation at said collar:

said interior portion proximate said upper end of said housing including a recessed circular portion; and a pair of annular ribs disposed in a spaced apart manner around an outer surface of said collar, for being captively retained within said recessed circular portion of said housing in a manner permitting rotation of said collar.

4. The device of claim 1, wherein said upper end includes:

a pair of upwardly directed studs extending from said housing, having inner opposing surfaces;

a pair of mounting recesses, each opposingly disposed in said inner opposing surfaces;

a cylindrical pin having first and second ends, said first and second ends of said pin being configured for pivotally mounting within said mounting recesses;

a connector having one end being connected to said support structure; and said cylindrical pin being configured to receive and retain another end of said connector a distance away from said structure.

5. The device of claim 1, wherein said lower end includes a circular fixed pulley having a circumferential groove for receiving a portion of said flexible elongated element.

6. The device of claim 1, wherein said lower end includes a semicircular fixed pulley having a circumferential groove extending proximate said first and second ends of said collar.

7. The device of claim 1, wherein said lower end includes a fixed pulley having a groove extending along the circumference of said pulley, and a plurality of bores extending transversely through said pulley.

8. The device of claim 1, wherein said collar and housing are made of a rigid plastic polymer composite.

9. The device of claim 1, wherein said collar and housing are made of a nylon composite.

10. The device of claim 2, wherein said annular collar further comprises:

a pair of opposing arcuate members forming a substantially cylindrical outer surface and a cylindrical inner opening therethrough when assembled together;

said cylindrical inner opening being adapted to fit tightly around said element; and said substantially cylindrical outer surface of said arcuate members being adapted to captively partially fit with freedom of radially turning movement within said cylindrical recess of said outer half sections.

11. The device of claim 4, wherein said connector is a cable.

12. The device of claim 5, wherein said lower end further includes:

a pair of reinforcing lips, each extending radially along opposing sides about the circumference of said groove, for abutting against a portion of said flexible elongated element proximate said collar; and said pair of lips being configured for seating a radial portion of said flexible elongated element within said groove.

13. A suspension device for effecting an attachment between a retriever cable being suspended from a spring-actuated reel in a fuel dispenser, and a fuel delivery hose connected to said fuel dispenser, said fuel delivery hose residing in an overhead storage position outside said fuel dispenser, wherein an improvement comprises said suspension device preventing the kinking or crimping of said fuel delivery hose at a point of attachment thereto, said suspension device comprising:

an annular collar adapted to be configured for gripping securely around an outside diameter of said fuel delivery hose, said collar having first and second ends;

a housing having upper and lower ends, and an interior portion proximate said upper end adapted to be configured said collar and a center axis of said fuel delivery hose;

said collar adapted to be mounted for rotation within said interior portion parallel with said center axis of said fuel delivery hose;

said upper end adapted to be configured for pivotal attachment with said retriever cable therewith; and said lower end adapted to be configured to limit the longitudinal bending of said fuel delivery, and adapted to be configured to restrict lateral bending of said fuel delivery hose against said first and second ends of said collar.

14. The device of claim 13, wherein said housing further comprises:

two identical outer sections each forming a half section of said housing, said half sections having inner surfaces adapted to be adjacent with each other when said device is assembled with said half sections secured together; and a semicircular recess being formed within said interior portion proximate said upper end of each of said outer half sections, said two semicircular recesses forming a substantially cylindrical recess when said outer half sections are assembled together.

15. The device of claim 13, wherein said lower end includes a circular fixed pulley having a circumferential groove for receiving a portion of said fuel delivery hose.

16. The device of claim 14, wherein said annular collar further comprises:

a pair of opposing arcuate members forming a substantially cylindrical outer surface and a cylindrical inner opening therethrough when assembled together;

said cylindrical inner opening being adapted to fit tightly around said fuel delivery hose; and said substantially cylindrical outer surface of said arcuate members being adapted to captively partially fit with freedom of radially turning movement within said cylindrical recess of said outer half sections.

17. The device of claim 13, wherein said upper end includes:

a pair of upwardly directed studs from said upper end of said housing, having inner opposing surfaces;

a pair of mounting recesses, each opposingly disposed in said inner opposing surfaces;

said retriever cable having one end connected to said spring-actuated reel;

a cylindrical pin having first and second ends, said pin being configured to receive and retain another end of said retriever cable a distance from said spring-actuated reel in said fuel dispenser; and said first and second ends of said pin being configured for pivotally mounting within said associated mounting recesses.

18. The device of claim 15, wherein said lower end further includes:

a pair of reinforcing lips, each extending radially along opposing sides about the circumference of said groove, for abutting against a portion of said fuel delivery hose proximate said collar; and said pair of lips being configured for seating a radial portion of said fuel delivery hose within said groove.

19. A device for maintaining an elongated hose comprising:

a clamp adapted to extend about at least a portion of the hose;

a substantially circular support device connected to said clamp and having an arcuate surface adapted do directly support a section of the hose within a plane; said clamp and said support device each having an axis and wherein said axes are orthogonal and spaced from each other and a collar movably positioned within said clamp and being aligned to rotate about an axis substantially parallel to said plane.

20. The device of claim 19, where said clamp is positioned along a middle portion of said support device such that said support device surface extends outward from said collar in two directions.

21. The device of claim 20, wherein said support device surface is substantially concave and aligns with said collar.

22. The device of claim 19, further including a retractable support line mounted to said clamp for adjusting the position of the device.

* * * * *